US005969276A

United States Patent [19]

Lindberg

[11] Patent Number: 5,969,276

[45] Date of Patent: Oct. 19, 1999

[54] MANGANESE CONTAINING MATERIALS HAVING HIGH TENSILE STRENGTH

[75] Inventor: Caroline Lindberg, Nyhamnsläge, Sweden

[73] Assignee: Höganäs AB, Höganäs, Sweden

[21] Appl. No.: 08/836,518

[22] PCT Filed: Nov. 21, 1995

[86] PCT No.: PCT/SE95/01377

§ 371 Date: May 19, 1997

§ 102(e) Date: May 19, 1997

[87] PCT Pub. No.: WO96/16759

PCT Pub. Date: Jun. 6, 1996

[30] Foreign Application Priority Data

Nov. 25, 1994 [SE] Sweden ..... 9404110

[51] Int. Cl.[6] ..... B22F 3/12; C22C 33/02; C22C 38/02; C22C 38/12

[52] U.S. Cl. ..... 75/246; 75/255; 419/38

[58] Field of Search ..... 419/38; 75/246, 75/255

[56] References Cited

U.S. PATENT DOCUMENTS 2,797,162 6/1957 Korczynsky ..... 75/124

*Primary Examiner*—Daniel J. Jenkins
*Attorney, Agent, or Firm*—Burns, Doane, Swecker & Mathis, L.L.P.

[57] ABSTRACT

The invention concerns an iron-based powder for powder-metallurgically producing components by powder compacting and sintering. The powder contains 0.25–2.0% by weight of Mo, 1.2–3.5% by weight of Mn, 0.5–1.75% by weight of Si and 0.2–1.0% by weight of C and not more than 2% by weight of impurities including less than 0.25% by weight of Cu. The invention also includes a method for preparing sintered components from this iron powder, as well as the sintered products.

23 Claims, 6 Drawing Sheets

FIG.I

MANGANESE CONTAINING MATERIALS HAVING HIGH TENSILE STRENGTH

FIELD OF THE INVENTION

The present invention relates to an iron-based powder for producing components by compacting and sintering. Specifically the invention concerns powder compositions which are essentially free from nickel and which, when sintered, give components having valuable properties, such as high tensile strength. The components can be used in e.g. the car industry. The invention also concerns a powder-metallurgically produced component of this powder as well as a method of powder-metallurgically producing such a component.

BACKGROUND

Nickel is a relatively common alloying element in iron-based powder compositions in the field of powder metallurgy, and it is generally known that nickel improves the tensile strength of the sintered components which have been made by iron powders containing up to 8% of nickel. Additionally, nickel promotes sintering, increases the hardenability and has a positive influence on the elongation at the same time.

A currently marketed powder, the use of which results in products having properties similar to those obtained with the product according to the present invention, is Distaloy®AE, which contains 4% by weight nickel.

There is however an increasing demand for powders which do not contain nickel as, for instance, nickel is expensive, creates dusting problems during the processing of the powder, and causes allergic reactions in minor amounts. From an environmental point of view the use of nickel should thus be avoided.

SUMMARY OF THE INVENTION

An object of the present invention is thus to provide a nickel-free powder composition having, at least in some respects, essentially the same properties as compositions containing nickel.

A second object is to provide a low-cost, environmentally acceptable material.

A third object is to provide sintered products which after both low and high temperature sintering have tensile strength values superior to those obtained with Distaloy®AE.

DETAILED DESCRIPTION OF THE PREFERRED EMBODIMENTS

Figure 1:
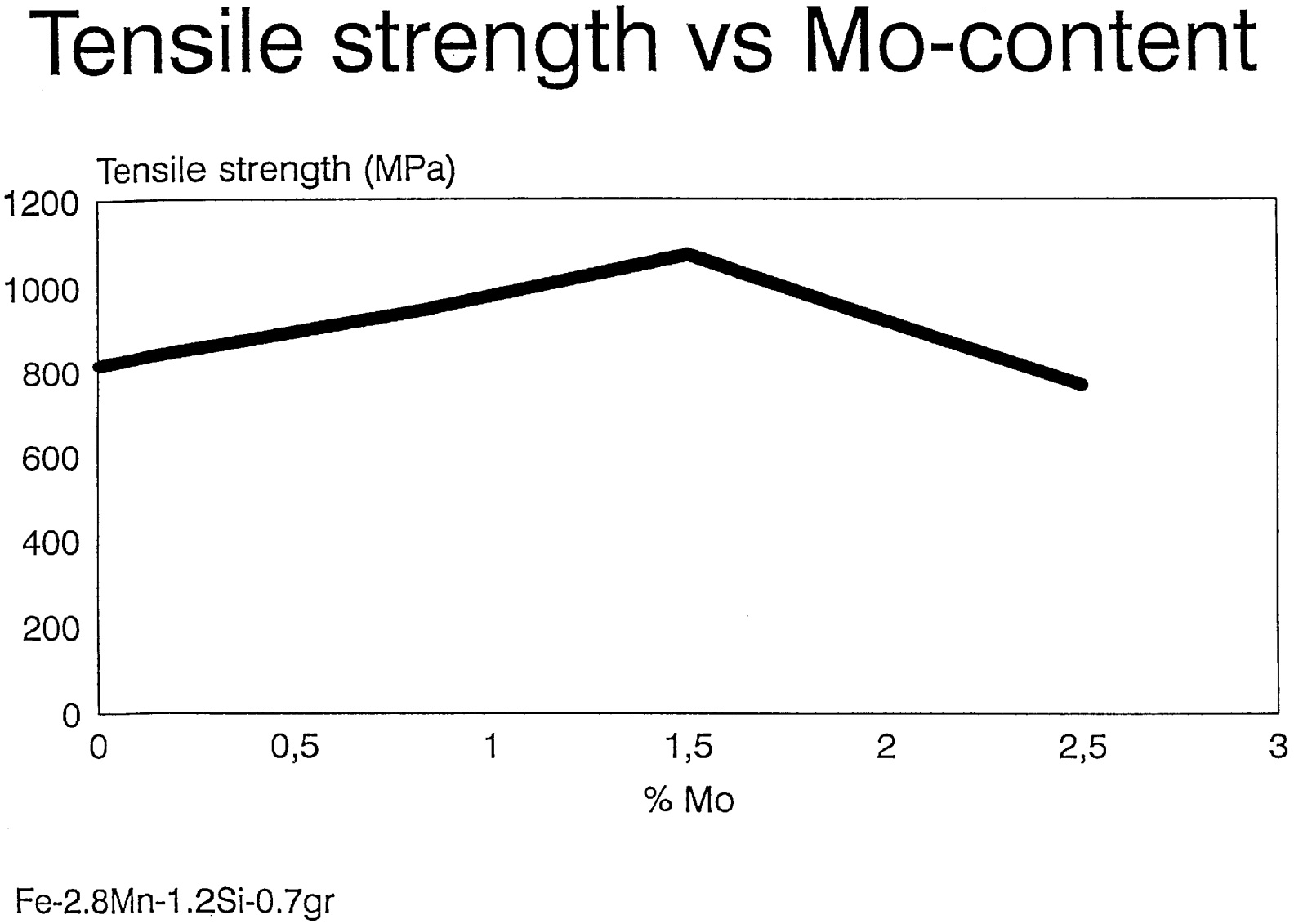
FIG. 1 is a graph of tensile strength versus Mo content.

According to the present invention, metal powders which, in addition to iron, contain 0.25–2.0% by weight of Mo, 1.2–3.5% by weight of Mn and 0.5–1.75% by weight of Si, 0.2–1.0% by weight of C and up to 2% by weight of impurities exhibit very interesting properties. Thus, tensile strengths up to 1200 MPa can be obtained, when the metal powders according to the invention are compacted and then sintered at high temperatures.

A preferred iron-based powder composition according to the invention contains 0.5–2% by weight of Mo, 1.2–3% by weight of Mn, 0.5–1.5% by weight of Si, 0.3–0.9% by weight of C, and less than 2% by weight of impurities including less than 0.25% by weight of Cu. In addition to Cu, the impurities can consist of Cr, Ni, Al, P, S, O, N, Be, B etc. in amounts less than 0.5% by weight, respectively.

Mo might be used as metal powder, partially pre-alloyed with Fe or prealloyed with Fe. When Mo is added to the iron powder, the hardenability of the compressed material increases and it is recommended that the amount of Mo should be at least 0.25% by weight. As, however, increasing amounts of Mo result in decreased compressibility and, accordingly, decreased density, the amount of Mo should preferably be less than about 2.0% by weight. Furthermore, too high amounts of Mo, especially in combination with high amounts of C, make the sintered material hard and brittle and the strength of the material will decrease.

Mo is preferably added in the form of a prealloyed base powder, which makes it possible to obtain a more homogenous microstructure consisting of bainite and martensite in the sintered material.

According to an especially preferred embodiment of the invention, Mo is added in the form of Astaloy Mo or Astaloy 85 Mo (available from Höganäs AB, Sweden) which contain 1.5 and 0.85% Mo, respectively.

Mn and Si improve the hardenability. Suitably these elements are added in amounts above 1.2 and 0.5% by weight, respectively. However, too high amounts of Mn and Si, such as above 3.5 and 1.75% by weight, respectively, result in decreased compressibility and can cause oxidation problems. High amounts of Mn and Si in a prealloyed base powder have a strong solution-hardening effect whereas these elements added in elementary form have a high affinity to oxygen.

If, however, these elements are added in the form of a master alloy, their affinity to oxygen is reduced and they become less sensitive to oxidation. Thus, according to a preferred embodiment of the invention, Mn and Si are added in the form of an Fe—Mn—Si-master alloy consisting of 10–30% by weight of Si, 20–70% by weight of Mn, the balance being Fe and having a weight ratio Mn/Si between 1 and 3. Such a master alloy may mainly consist of, for example, $(Fe,Mn)_3Si$ and $(Fe,Mn)_5Si_3$ and is disclosed in EP 97 737. The master alloy also gives an improved compressibility and the microstructure of the sintered material becomes more homogenous, due to the fact that, during sintering, the Fe—Mn—Si-master alloy forms a transient liquid phase which accelerates sintering, facilitates diffusion, increases the amount of martensite and makes the pores rounder. With the master alloy it is possible to avoid the large shrinkage normally caused by silicon and get a dimensional change close to zero. Alternatively, Mn and Si can be added in the form of ferro-manganese and ferrosilicon.

If the amount of C, which is normally added as a graphite powder, is less than 0.2%, the tensile strength will be too low, and if the amount of C is above 1.0%, the sintered component will be too brittle. Components prepared from compositions according to the present invention wherein the C content is relatively low exhibit good ductility and acceptable tensile strength, whereas products prepared from compositions having higher amounts of C have lower ductility and increased tensile strength. The graphite addition has to be made with respect to the sintering atmosphere. The more hydrogen in the atmosphere the more graphite has to be added due to greater decarburization. As some carbon normally disappears during sintering, the carbon content of the sintered product will be somewhat less than the carbon content of the iron-based powder. Thus, the carbon content of the sintered products normally varies between 0.15 and 0.70% by weight.

As possible impurities Ni, Cu and Cr may be mentioned. These elements can be present in amounts less than 0.25% by weight, respectively, but should preferably be present only as traces, i.e. up to 0.1% by weight of the composition. Other possible impurities are Al, P, S, O, N, Be, B in amounts <0.25% Cr, <0.25% Cu, <0.25% Ni, <0.20% Al, <0.05% P, <0.05% S, <0.05% O, <0.03% N, <0.02% N, <0.01% Be, <0.02% B, <0.5% others claims. The total amount of impurities should be less than 2% by weight but is preferably less than 1% by weight.

Figure 2:
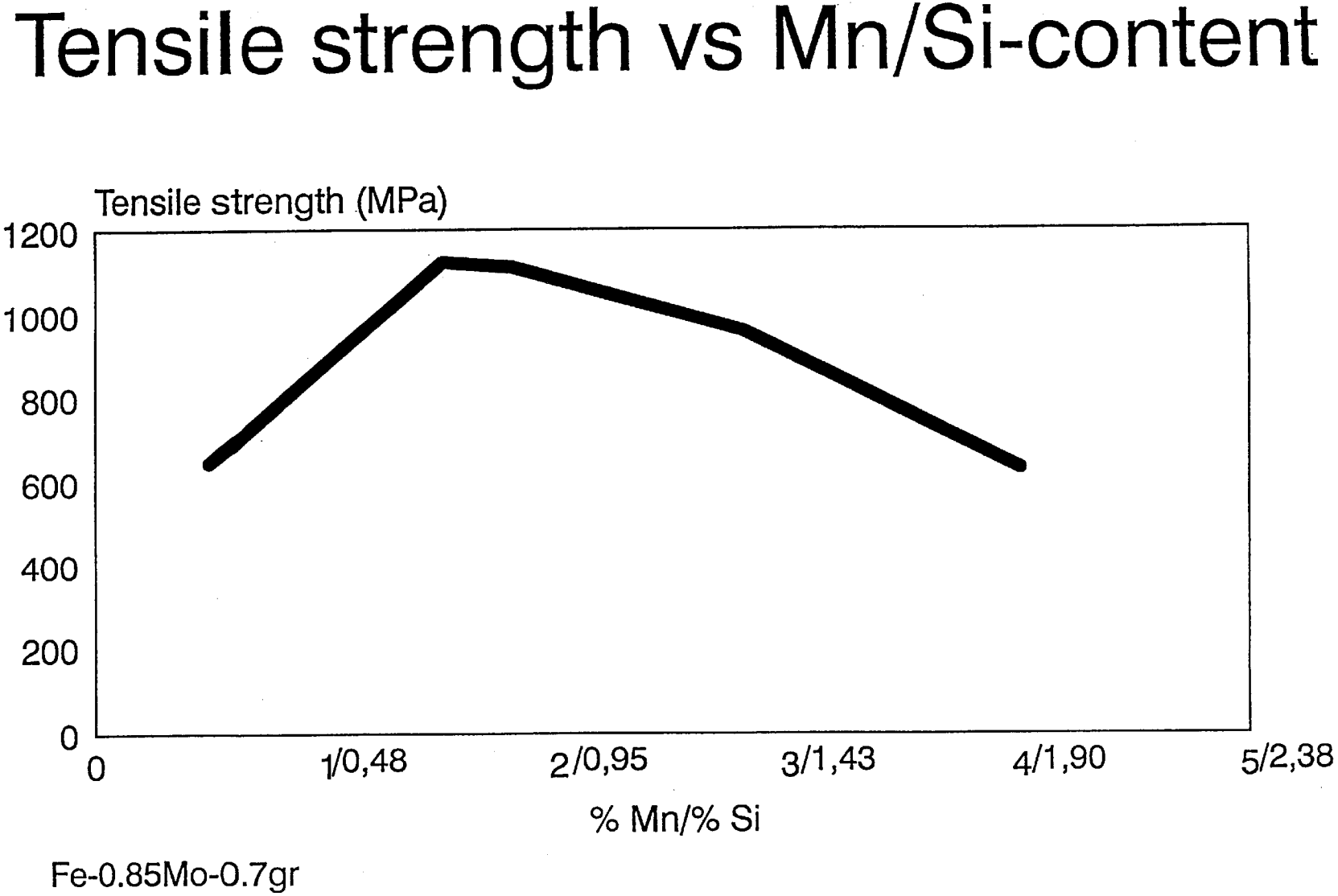
FIG. 2 is a graph of tensile strength versus Mn—Si content.
Figure 3:
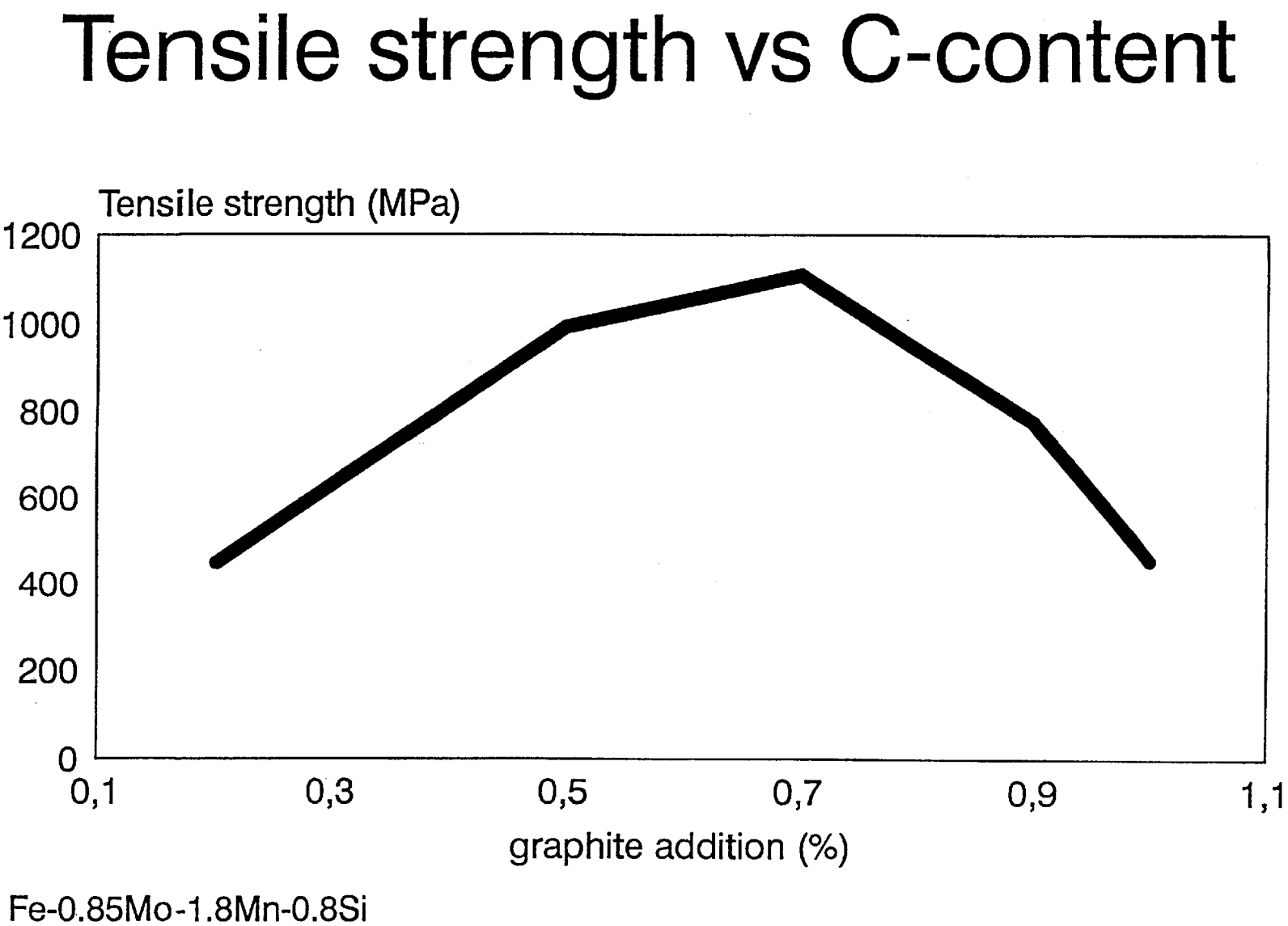
FIG. 3 is a graph of tensile strength versus C content.

The influence of the addition of different amounts of Mo, Mn/Si and C is disclosed in FIGS. 1, 2 and 3, respectively.

In addition to the iron-based powders, the present invention also concerns methods of producing components by using these new powders as well as the components produced. The powder-metallurgical method is carried out in a conventional way known to the man skilled in the art and includes the steps of compacting, sintering and optionally recompacting and sintering and/or quenching and tempering of the powder. The compacting step could be carried out both as a cold and warm compacting step and the sintering step could be carried out as low-temperature sintering as well as high-temperature sintering. The sintering atmosphere as well as the sintering times have an impact on the properties of final product as is well known in the art.

In this context it can be mentioned that WO 80/01083 discloses alloy steel articles having a composition similar to the composition of the present products. These known products are, however, conventional, wrought, pore free products prepared by casting. A special subsequent heat treatment, austempering is made in order to obtain products having a substantially complete bainite structure. In addition to the ranges of the alloying elements, these known products differ from the product prepared according to the present invention in several respects, such as the type of starting materials, the process routes and the microstructure.

It has quite unexpectedly been found that materials having tensile strengths up to about 1200 MPa can be obtained by using the new iron-based compositions. These remarkably high values can be obtained, for instance, by high temperature sintering between about 1200° C. and 1280° C. for periods of about an hour in hydrogen atmosphere. Noteworthy is also the fact that the compressed bodies made of the iron-based powder according to the present invention, when subjected to low-temperature sintering, i.e. sintering between 1110° C. and 1150° C., are also distinguished by very high tensile strengths up to 1000 MPa. It has also been observed that unexpextedly high tensile strengths are obtained at relatively moderate densities, such as 6.8–7.0 g/cm$^3$. Additionally, it has been found that the new compositions exhibit good stability in dimensional change at different densities.

In brief, the high tensile strength of the sintered products according to the invention in combination with the low cost of the powder and modest influence on the environment makes the present invention especially interesting.

The invention is described more in detail in the following example.

EXAMPLE

Different alloying compositions with respect to Mo, Mn, Si and C have been tested. A master alloy with a composition of 45% Mn, 21% Si and balance Fe has been used in the following trials. The master alloy, graphite and in some trials also Mo powder were admixed to ASC100.29, Astaloy 85 Mo or Astaloy Mo. Tensile testbars were compacted at 600 MPa followed by sintering at 1250° C. for 30–60 minutes in a mixed hydrogen nitrogen atmosphere. Optimal strength properties were achieved at molybdenum contents of 0.25–2.0%, as shown in FIG. 1. The hardenability is too low at small additions whereas the density becomes too low at higher molybdenum additions. The Mo content is preferably between 0.5 and 2%. In addition to iron and different amounts of Mo, the tested powder contained 2.8% Mn, 1.2% Si and 0.7% graphite.

Smaller master alloy additions result in a low hardenability of the material and thereby a low strength. High alloying additions lead to a large volume of master alloy which decreases the compressibility and will also result in increased swelling of the material. The strength will thereby decrease due to the lower density. The manganese and silicon additions are optimal between 1 and 3.5% Mn and between 0.5 and 1.75% Si, respectively, as shown in FIG. 2. In addition to iron and varying amounts of Mn, Si, the tested powder included 0.85% Mo and 0.7% graphite.

Figure 4:
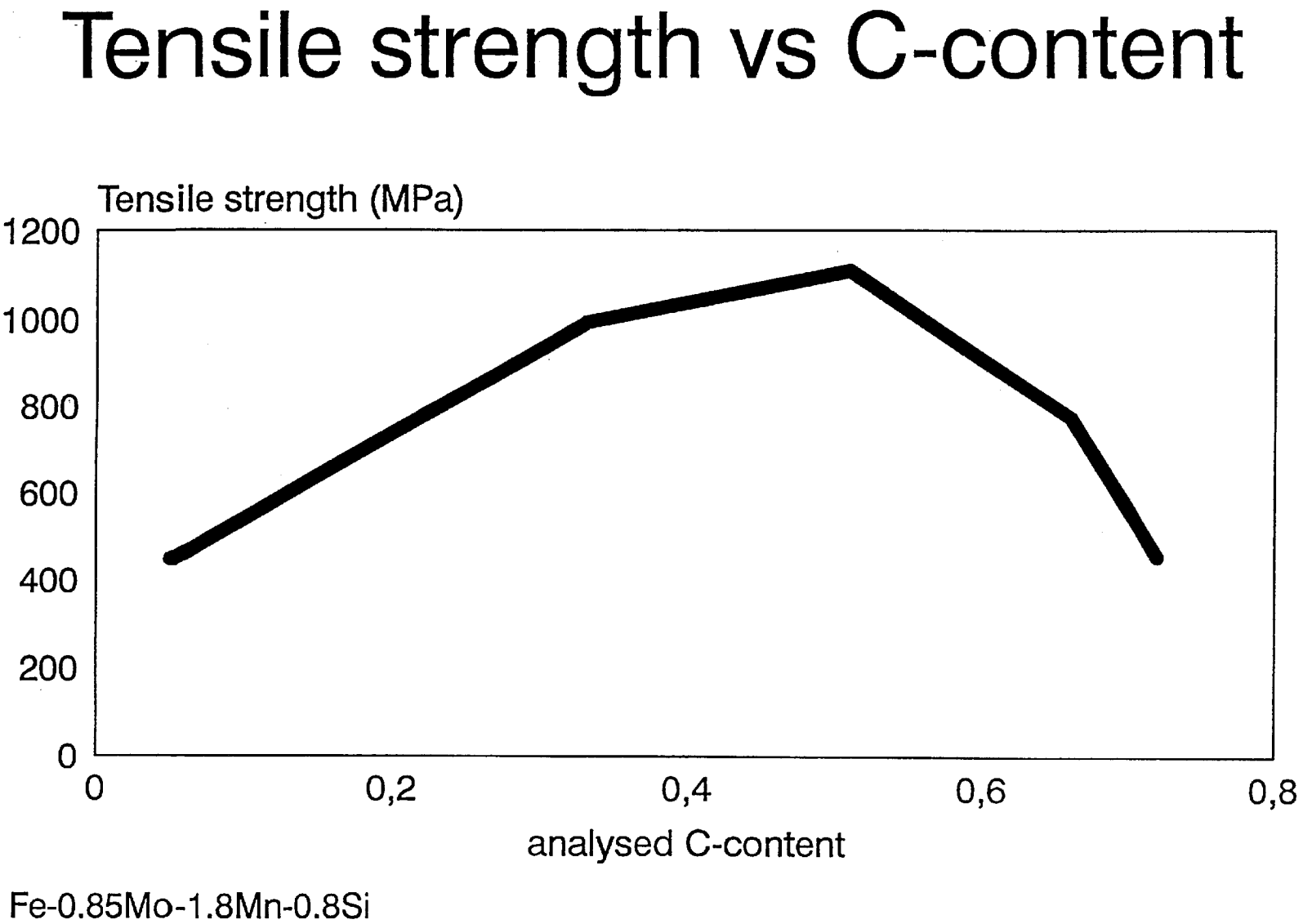
FIG. 4 is a graph of tensile strength versus C content.

The analysed carbon content depends on the amount of graphite added and also on which sintering atmosphere that has been used. A higher hydrogen content of the sintering atmosphere produces larger decarburisation. The carbon content of the sintered product is optimal between 0.15 and 0.7%, as shown in FIG. 4. In these trials this corresponds to 0.3–0.9% graphite in the powder composition, as shown in FIG. 3. The tested iron-based powder contained 0.85% Mo, 1.8% Mn, 0.8% Si and varying amounts of graphite.

Figure 5:
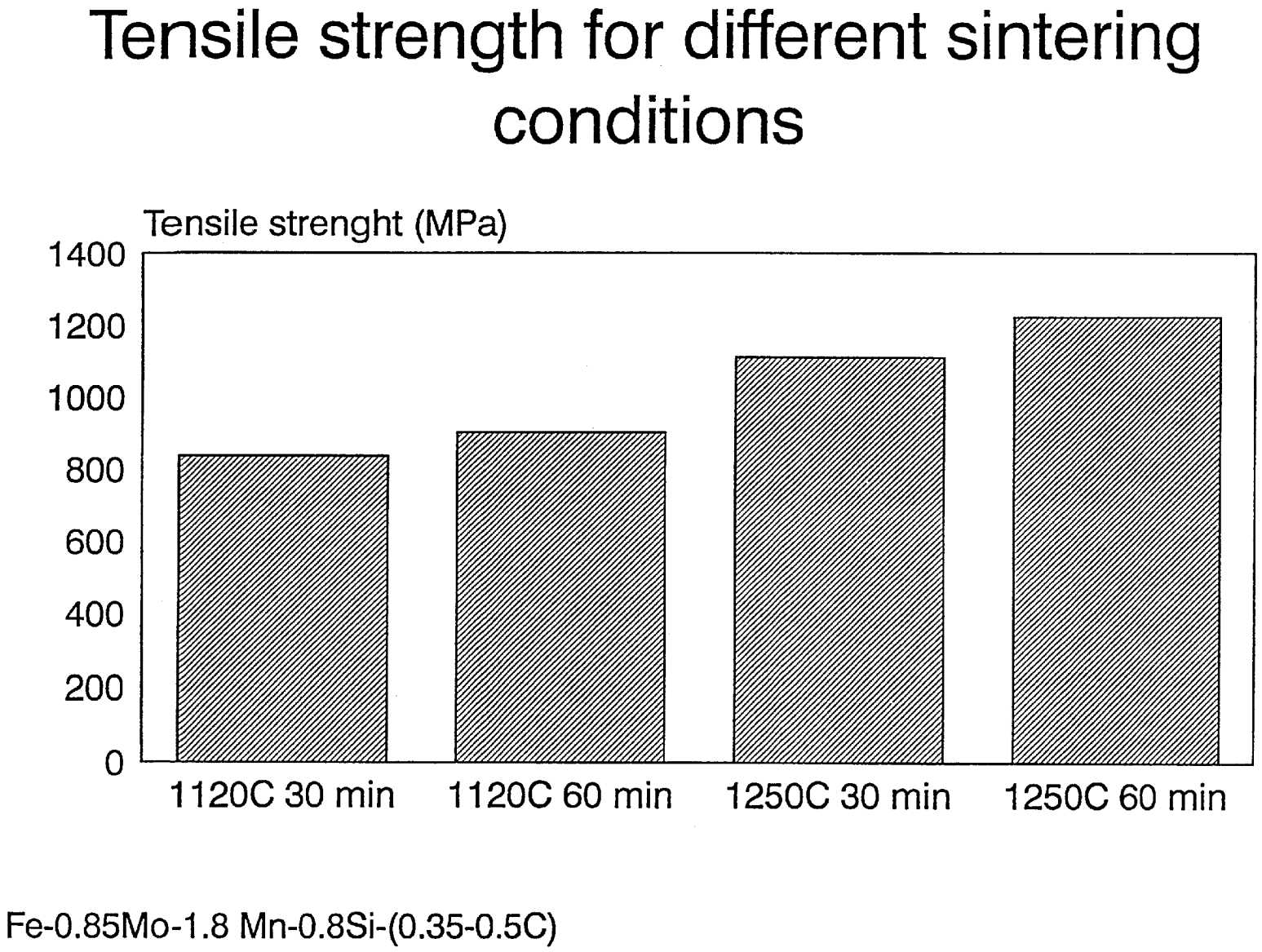
FIG. 5 is a bar graph showing tensile strength for different sintering conditions.

The strength of the material is increased by increasing sintering temperature and time. This is mainly due to a better diffusion of the admixed alloying elements, which improves the hardenability and thereby the strength of the material. This effect can be seen in FIG. 5 for a powder consisting of iron, 0.85% Mo, 1.8% Mn, 0.8% Si and 0.5–0.7% graphite.

Figure 6:
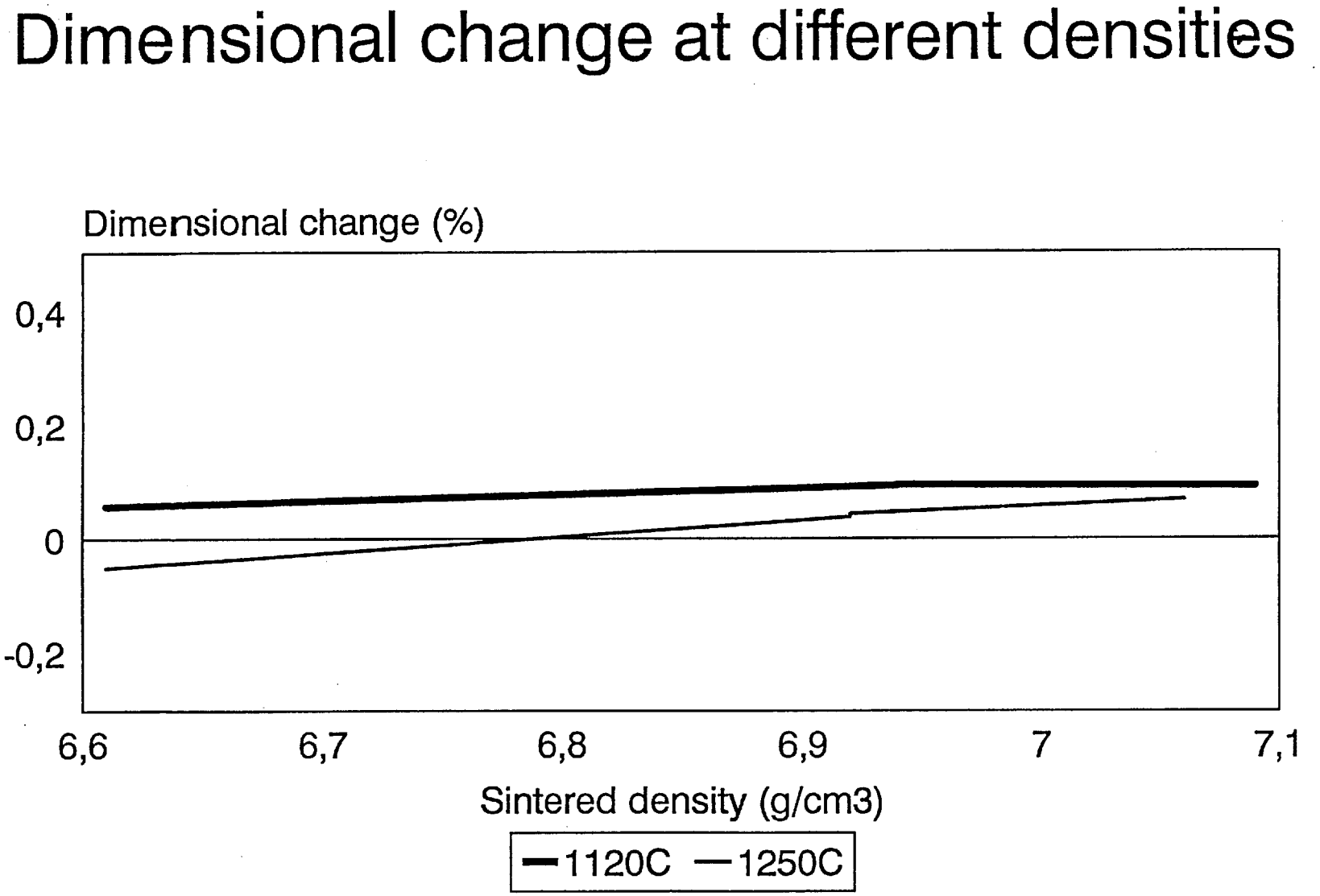
FIG. 6 is a graph of dimensional charge versus sintered density.

The dimensional change at different densities is stable for the newly developed material. This is a great benefit when producing components having a great internal density variation. It becomes easier to keep narrow tolerances by using a dimensionally stable material. FIG. 6 discloses the variation of the dimensional change for Fe-0.85Mo-1.8Mn-0.8Si-(0.6–0.7 C) compacted at 400, 600 and 800 MPa. Sintering was performed at 1120° C. and 1250° C. The variation in dimensional change is 0.03% and 0.12%, respectively, in the density range 6.6–7.1 g/cm$^3$.

I claim:

1. An iron-based powder for producing porous components by powder compacting and sintering, comprising in addition to iron 0.25–2.0% by weight of Mo 1.2–3.5% by weight of Mn 0.5–1.75% by weight of Si 0.2–1.0% by weight of C and not more than 1% by weight of impurities including less than 0.25% by weight of Cu and less than 0.25% by weight of Ni.

2. A powder according to claim 1, characterised in that the amount of Mo is 0.6–2.0% by weight.

3. A powder according to claim 1, characterised in that the amount of Mn is 1.3–3.0% by weight.

4. A powder according to claim 1, characterised in that the amount of Si is 0.7–1.50% by weight.

5. A powder according to of claim 1, characterised in that the amount of C is 0.3–0.9% by weight.

6. A powder according to of claim 1, characterised in that Mn and Si are added in the form of ferromanganese, ferrosilicon or a silicon-manganese-iron master alloy.

7. A powder according to claim 6, characterised in that the weight ratio manganese/silicon of the silicon-manganese-iron master alloy varies between 1 and 3.

8. A powder according to claim 1, characerterised in that Mo is added in the form of a prealloy of Fe and Mo.

9. A powder according to claim 1, characterised in that it includes inevitable impurities in the following ranges Cr<0.25

Cu<0.25

Ni<0.25

Al<0.20

P<0.05

S<0.05

O<0.03

N<0.02

Be<0.01

B<0.02

Others<0.5.

10. A powder-metallurgically produced porous component, which in addition to iron comprises 0.25–2.0% by weight of Mo 1.2–3.5% by weight of Mn 0.5–1.75% by weight of Si 0.2–0.70% by weight of C and not more than 1% by weight of impurities including less than 0.25% by weight of Cu and less than 0.25% by weight Ni.

11. A method of powder-metallurgically producing sintered porous components, characterised by using an iron-based powder comprising 0.25–2.0% by weight of Mo 1.2–3.5% by weight of Mn 0.5–1.75% by weight of Si 0.2–1.0% by weight of C and not more than 1% by weight of impurities including less than 0.25% by weight of Cu and less than 0.25% by weight Ni; compacting the powder into the desired shape and sintering the compact at a temperature above 1120° C.

12. A powder according to claim 2, characterised in that the amount of Si is 0.5–1.50% by weight.

13. A powder according to claim 3, characterised in that the amount of Si is 0.5–1.50% by weight.

14. A powder according to claim 2, characterised in that the amount of C is 0.3–0.9% by weight.

15. A powder according to claim 3, characterised in that the amount of C is 0.3–0.9% by weight.

16. A powder according to claim 2, characterised in that Mn and Si are added in the form of ferromanganese, ferrosilicon or a silicon-manganese-iron master.

17. A powder according to claim 3, characterised in that Mn and Si are added in the form of ferromanganese, ferrosilicon or a silicon-manganese-iron master.

18. A component according to claim 10, having a homogeneous microstructure of bainite and martensite.

19. A powder according to claim 1, having a homogenous microstructure of bainite and martensite when sintered.

20. A method according to claim 11, wherein the sintered compact has a homogenous microstructure of bainite and martensite.

21. A component according to claim 10, having less than 0.15% Cu.

22. A powder according to claim 1, having less than 0.15% Cu.

23. A method according to claim 11, wherein the sintered compact has less than 0.15% Cu.

* * * * *